US005325925A

United States Patent [19]

Smith et al.

[11] Patent Number: 5,325,925

[45] Date of Patent: Jul. 5, 1994

[54] SEALING METHOD AND APPARATUS FOR WELLHEADS

[75] Inventors: Jerry D. Smith; Philip F. Huang, both of Houston, Tex.

[73] Assignee: Ingram Cactus Company, Houston, Tex.

[21] Appl. No.: 904,461

[22] Filed: Jun. 26, 1992

[51] Int. Cl.[5] ..... E21B 33/12

[52] U.S. Cl. ..... 166/387; 166/196; 166/348; 166/368; 277/116.2

[58] Field of Search ..... 166/182, 321, 115, 387; 277/116.2, 236

[56] References Cited

U.S. PATENT DOCUMENTS

| | | | |
|---|---|---|---|
| 4,131,287 | 12/1978 | Gunderson et al. | 277/236 X |
| 4,556,224 | 12/1985 | Le | 277/118 |
| 4,588,029 | 5/1986 | Blizzard | 166/120 |
| 4,646,845 | 3/1987 | Boeker | 166/387 |
| 4,665,979 | 5/1987 | Boehm, Jr. | 277/236 |
| 4,742,874 | 5/1988 | Gullion | 277/236 |
| 4,751,965 | 6/1988 | Cassity | 277/236 X |
| 4,823,871 | 4/1989 | McEver et al. | 277/236 X |
| 5,044,672 | 9/1991 | Skeels et al. | 277/236 X |
| 5,110,144 | 5/1992 | Burton et al. | 166/115 |

OTHER PUBLICATIONS

"Metal Seals Come of Age", Petroleum Engineer International May 1992, pp. 30, 32, 34, 36.

"Advanced Sealing Technology," FMC Brochure, p. 5 and unnumbered page with FIG. 1 (undated).

"Development of an All-Metal-Sealing Subsea Wellhead System for Critical Service Applications", SPE Paper 23056, presented at 23rd OTC May 6-9, 1991, pp. 253-258.

"Seal Assembly", Dril-Quip Ad, undated.

"SB Subsea Wellhead System" National-Oilwell Bulletin No. 151, 1 page (undated).

*Primary Examiner*—Thuy M. Bui
*Assistant Examiner*—Frank S. Tsay
*Attorney, Agent, or Firm*—Ben D. Tobor

[57] ABSTRACT

A metal-to-metal sealing method and apparatus for use on oil and/or gas wells, utilizes an upper seal member and a lower seal member, wherein the energizing of the seal members is staged to cause the lower seal member to become sealingly engaged. before the upper seal member becomes sealingly engaged. The seal members may have two seals of different construction; one seal is an interference type seal, and the other seal is a wedge type seal.

64 Claims, 9 Drawing Sheets

Fig. 4
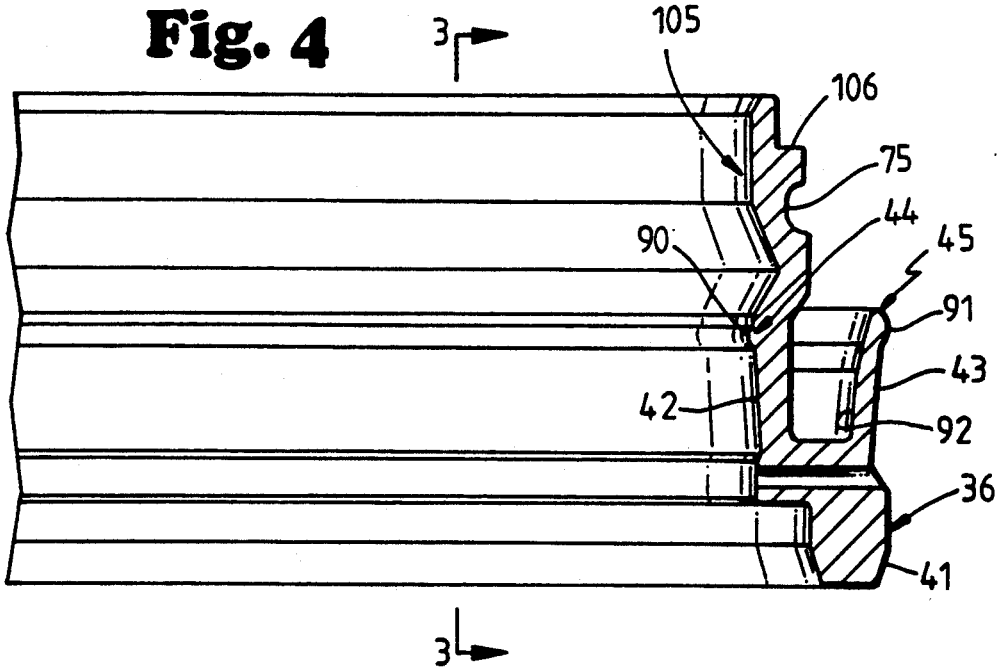
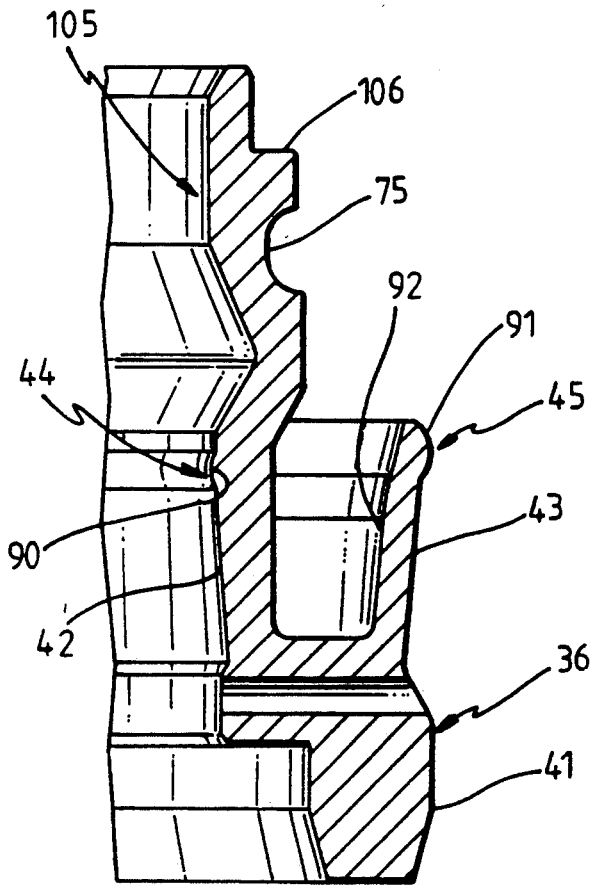
Fig. 3

SEALING METHOD AND APPARATUS FOR WELLHEADS

BACKGROUND OF THE INVENTION

1. Field of the Invention

The invention relates to a sealing method and apparatus for sealing an annulus between an outer surface of an oil and/or gas well tubing or casing hanger and an inner surface of a wellhead housing.

2. Description of the Prior Art

Oil and/or gas wells typically include one or more pipe strings extending downwardly into the earth from its surface. The strings are included one within the other and serve various purposes, such as maintaining the structural integrity of the well and for controlling fluid flow and fluid pressures within the well. A "string" is referred to as casing if there is at least one string within that string, and the innermost string is referred to as tubing.

At the wellhead, various types of wellhead members are connected and sealed to the casing and tubing and perform various functions, among which are: to support the casing and tubing from the surface; to provide means for connecting fluid conduits to the tubing as well as to the annuli defined by the tubing and the various casing strings surrounding it; and for maintaining control of the fluid pressures experienced within the wellhead. To maintain control of the often very high fluid pressures, it is necessary to provide seals between the various wellhead members and the tubing and casing. Elastomeric seals have been provided in such devices which provide a seal against the tubing and casing when the seal is pressed inwardly thereagainst. This is achieved in various devices by exerting pressure vertically against the seal causing it to expand inwardly against the tubing or casing thus to seal it off. The elastomeric seal may be urged inwardly also by pressure exerted upon its outer circumferential surface. For example, such seals have been in use for many years wherein fluid pressure is exerted in an annulus surrounding the outer diameter of the elastomeric seal thus to urge it inwardly. The annulus is connected to the exterior of the device by means of a check valve through which fluid under pressure is introduced. In some types of sealing methods, a liquid plastic under pressure is injected through the check valve for forming the seals, and thereafter the plastic hardens so that the seal is permanently maintained.

Many well operators believe that elastomeric seals may be unreliable under extremes of temperature and high pressures, which may cause them to breakdown, leading to an undesirable failure of the seal. Accordingly, metal-to-metal type seals have been adopted for use in order to overcome the foregoing temperature sensitivity problems of elastomeric materials. Various types of metal-to-metal seals have been proposed; however, they suffer from many disadvantages. Examples of such disadvantages include high setting force loads are required in order to force the seal into engagement. In many instances, complex hydraulically-operated systems are required to energize the seal, and typically include additional tools to lock the seal in the desired sealing engagement. Many metal-to-metal type seals utilize a solid wedge to force the seal into engagement with the desired surface; however, temperatures changes experienced by the wellhead and casing or tubing strings, and differential expansion and/or contraction of the various metal parts associated with such temperature changes, can cause the desired sealing to be lost. Some prior art seals permit movement of some components with respect to each other after achieving the desired sealing, whereby it is possible that undesired movement of some components can cause the seal to fail.

Some types of metal-to-metal seals seal against a tapered surface disposed on the wellhead housing and/or tubing or casing hanger. If there is longitudinal movement of either the seal or the adjacent tapered surface, which can be caused by differential expansion or contraction caused by temperature changes or changing tensile force loads on the casing or tubing, the seal may move off the tapered surface and thus destroy the desired sealing. Another disadvantage associated with many types of metal-to-metal seals is that the seals may not be subjected to an external pressure test, nor can the well operator visually determine if the desired sealing has been accomplished. Another disadvantage is that some types of metal-to-metal seals do not provide for a stored energy preload force which takes advantage of the resilience and the elastic/plastic properties of the metal used to make the seal, so as to constantly urge the seal into the desired sealing engagement with its adjacent surfaces. A further disadvantage with many metal-to-metal seals, which utilize multiple seals, is that the multiple seals are set at the same time, rather than independently of one another. It may be difficult to determine whether or not all of the multiple seals have been properly set into sealing engagement.

Accordingly, prior to the development of the present invention, there has been no single sealing method and apparatus for sealing an annulus between an outer surface of an oil and/or gas well tubing or casing hanger and an inner surface of wellhead housing which: does not require high setting force loads; does not require a complex hydraulically operated system and additional tools to lock the seal in its desired sealing engagement; does not use a solid wedge subject to differential temperature changes which could cause the seal to fail; is not sealed against a tapered sealing surface; permits an external pressure test and enables the well operator to visually determine if sealing has been accomplished; has a stored energy preload force to maintain the desired sealing; sets multiple seals independently of each other; and upon sealing becomes a relatively solid seal assembly, the various components of which are not subject to movement relative to each other. Therefore, the art has sought a sealing method and apparatus for sealing an annulus between an outer surface of an oil and/or gas well tubing or casing hanger and an inner surface of a wellhead housing which: does not require high setting force loads; does not require a complex hydraulically operated system to set the seals, and additional tools to lock the seal in the desired sealing engagement with adjacent surfaces; does not utilize a solid wedge subject to differential temperature changes which can cause the seal to fail; seals upon a straight, non-tapered sealing surface; can be tested by an external pressure test and can permit the well operator to visually determine the setting of the seal; has a stored energy preload force to constantly urge the seal into sealing engagement; sets multiple seals independent of each other; and upon sealing becomes a relatively solid assembly with its individual components not subject to movement relative to each other so as to maintain the desired sealing.

SUMMARY OF THE INVENTION

In accordance with the present invention, the foregoing advantages have been achieved through the present seal assembly for sealing an annulus between concentric spaced apart inner and outer generally cylindrical surfaces, each surface having an upper and a lower portion, the seal assembly adapted to be disposed within the annulus. The present invention includes: an upper seal member formed of a metallic material and adapted to be disposed adjacent the upper portions of the surfaces; a lower seal member formed of a metallic material and adapted to be disposed adjacent the lower portions of the surfaces; an energizing ring member, disposed between the upper and lower seal members, for energizing the upper and lower seal members to engage, and seal against, adjacent surfaces; means for causing relative motion between the energizing ring and the upper and lower seal member; and first means for staging the energizing of the upper and lower seal members to cause the lower seal member to engage, and seal against, the lower portions of the surfaces before the upper seal member engages, and seals against the upper portions of the surfaces. A feature of the present invention is that the lower seal member may have an inner seal adapted for engaging, and sealing against, the lower portion of the inner generally cylindrical surface, and an outer seal adapted for engaging, and sealing against, the lower portion of the outer generally cylindrical surface; and a second means for staging the energizing of the inner and outer seals of the lower seal member, to cause one of the seals of the lower seal member to engage, and seal against, one of the lower portions of one of the surfaces, before the other seal of the lower seal member engages, and seals against, the other lower portion of the other surface.

Another feature of the present invention is that the upper seal member may have an inner seal adapted for engaging, and sealing against, the upper portion of the inner generally cylindrical surface, and an outer seal, adapted for engaging, and sealing against, the upper portion of the outer generally cylindrical surface; and a third means for staging the energizing of the inner and outer seals of the upper seal member, to cause one of the seals of the upper seal member to engage, and seal against, one of the upper portions of one of the surfaces, before the other seal of the upper seal member engages, and seals against, the other upper portion of the other surface. A further feature of the present invention is that the inner seal may be an interference type seal, wherein sealing between the inner seal and the lower portion of the inner surface is accomplished by an interference fit of the inner seal with the lower portion of the inner surface; and the outer seal is a wedge type seal, wherein the sealing between the outer seal and the lower portion of the outer surface is accomplished by the outer seal being wedged into sealing engagement with the lower portion of the outer surface.

In accordance with another aspect of the present invention, the foregoing advantages have also been achieved through the present seal assembly for sealing an annulus between concentric spaced apart inner and outer generally cylindrical surfaces, each surface having an upper and a lower portion, the seal assembly adapted to be disposed within the annulus. The present invention may include an upper ring-shaped seal member formed of a metallic material and adapted to be disposed adjacent the upper portions of the surfaces, the upper seal member having a generally U-shaped configuration with inner and outer downwardly extending leg members, with an inner seal disposed on the inner leg member and an outer seal disposed on the outer leg member; a lower ring-shaped seal member formed of a metallic material and adapted to be disposed adjacent to the lower portions of the surfaces, the lower seal member having a generally U-shaped configuration with inner and outer upwardly extending leg members, with an inner seal disposed on the inner leg member and an outer seal disposed on the outer leg member; an energizing ring member, disposed between the upper and lower seal members, for energizing the upper and lower seal members to engage, and seal against the surfaces; and means for causing relative motion between the energizing ring member and the upper and lower seal members. A further feature of the present invention is that the inner seals on the upper and lower inner leg members may be interference type seals and sealing between the inner seals and their adjacent inner surfaces is accomplished by an interference fit of the inner seals, disposed on the inner leg members, with their adjacent inner surfaces; and the outer seals are wedge type seals, and the sealing between the upper seals and their adjacent outer surfaces is accomplished by the outer seals being wedged into sealing engagement with the adjacent outer surfaces.

Another feature of the present invention is that portions of the energizing ring member may engage the outer leg members to wedge the outer seals into sealing engagement with their adjacent outer surfaces, which causes portions of the energizing ring member to be deflected inwardly toward the inner leg members, and the deflected portions of the energizing ring members apply an outwardly extending force upon the outer leg members to maintain the outer seals in sealing engagement with the adjacent outer surfaces. An additional feature of the present invention is that the deflected portions of the energizing ring member may be spaced from the inner leg members to permit the deflected portions of the energizing ring to store energy to apply the outwardly extending force to the outer leg members and outer seals.

In accordance with another aspect of the present invention, the foregoing advantages have also been achieved through the present oil and/or gas well tubing or casing hanger, for use with a seal assembly having an upper and lower seal member. This aspect of the present invention may include: a generally tubular shaped member having upper and lower ends, and an outer surface; the outer surface of the upper end having a first tapered surface, adapted to be disposed adjacent to the upper seal member, which first tapered surface tapers downwardly and outwardly to provide the upper end of the tubular shaped member with a first enlarged diameter; and the outer surface of the upper end having a second tapered surface, adapted to be disposed adjacent the lower seal member, which second tapered surface tapers downwardly and outwardly to provide the upper end of the tubular shaped member with a second enlarged diameter. A feature of this aspect of the present invention is that the second enlarged diameter may be larger than the first enlarged diameter.

In accordance with another aspect of the present invention, the foregoing advantages have also been achieved through the present method for sealing an annulus between concentric, spaced apart inner and outer generally cylindrical surfaces, each surface having an upper and lower portion. This aspect of the present invention may include the steps of: disposing a seal assembly, having upper and lower metallic seal members, within the annulus adjacent the inner and outer surfaces; energizing the seal assembly to first cause the lower seal member to engage, and seal against, the lower portions of the surfaces, before the upper seal member has engaged, and sealed against, the upper portions of the surfaces; and energizing the seal assembly to then cause the upper seal member to engage, and seal against, the upper portions of the surfaces. A feature of this aspect of the present invention includes the steps of: utilizing a lower seal member having an inner seal for engaging, and sealing against, the lower portion of the inner surface and an outer seal for engaging, and sealing against, the lower portion of the outer surface; and energizing the seal assembly to cause seal for engaging, and sealing against, the lower portion of the outer surface; and energizing the seal assembly to cause one of the seals of the lower seal member to engage, and seal against, one of the lower portions of one of the surfaces, before the other seal of the lower seal member engages, and seals against, the other lower portion of the other surface.

Another feature of this aspect of the present invention includes the steps of: first locking the lower seal member to maintain the inner and outer seals of the lower seal member in sealing engagement with the lower portions of the inner and outer surfaces, after the inner and outer seals of the lower seal member have sealed against the lower portions of the surfaces; and thereafter energizing the seal assembly to cause the upper seal member to engage, and seal against, the upper portions of the surfaces. Another feature of the present invention may include the steps of: utilizing, as the lower seal member inner seal, an interference type seal, and sealing between the inner seal and the lower portion of the inner surface by forcing the inner seal into an interference fit with the lower portion of the inner surface; utilizing, as the lower seal member outer seal, a wedge type seal, and sealing between the outer seal and the lower portion of the outer surface by wedging the outer seal into sealing engagement with the lower portion of the outer surface.

A further feature of the present invention may include the steps of: utilizing an upper seal member having an inner seal for engaging, and sealing against, the upper portion of the inner surface, and an outer seal for engaging, and sealing against, the upper portion of the outer surface; and energizing the seal assembly to cause one of the seals of the upper seal member to engage, and seal against, one of the upper portions of one of the surfaces, before the other seal of the upper seal member engages, and seals against, the other upper portion of the other surface. An additional feature of the present invention may include the steps of storing energy member. A further feature of the present invention may include the step of applying a pressure force from an external source to a cavity, disposed between the upper and lower seal members, to test the pressure integrity of the upper and lower seal members.

A further feature of the present invention may include the step of utilizing a torque force to energize the upper and lower seal members of the seal assembly, and the torque force may be applied to the seal assembly by rotating an actuation sleeve member downwardly into engagement with the upper seal member to cause relative motion between the upper seal member and the lower seal member. A further feature of the present invention may include the step of sealing the inner seals of the upper and lower seal members against an inner surface which is parallel with the longitudinal axis of the seal assembly.

The sealing method and apparatus of the present invention, when compared with previously proposed sealing methods and apparatus, have the advantages of: not requiring high setting force loads; does not require a complex hydraulically-operated system to set the seals and additional tools to lock the seals in their desired sealing engagement; not being readily susceptible to differential temperature and pressure changes, which could cause a failure of the seal; not sealing upon a tapered sealing surface; permitting an external pressure test of the seals and permitting the well operator to visually determine the setting of the seals; providing for a stored energy preload force to constantly apply a force to maintain the desired sealing engagement; setting multiple seals independently of one another; and, upon sealing, becoming a relatively solid assembly, wherein the components of the seal assembly are not subject to movement relative to each other.

BRIEF DESCRIPTION OF THE DRAWINGS

FIG. 3 is a cross-sectional view of a lower seal member of the seal assembly of the present invention, taken along line 3—3 of FIG. 4;

FIG. 4 is a partial cross-sectional view of the lower seal member of FIG. 3;

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
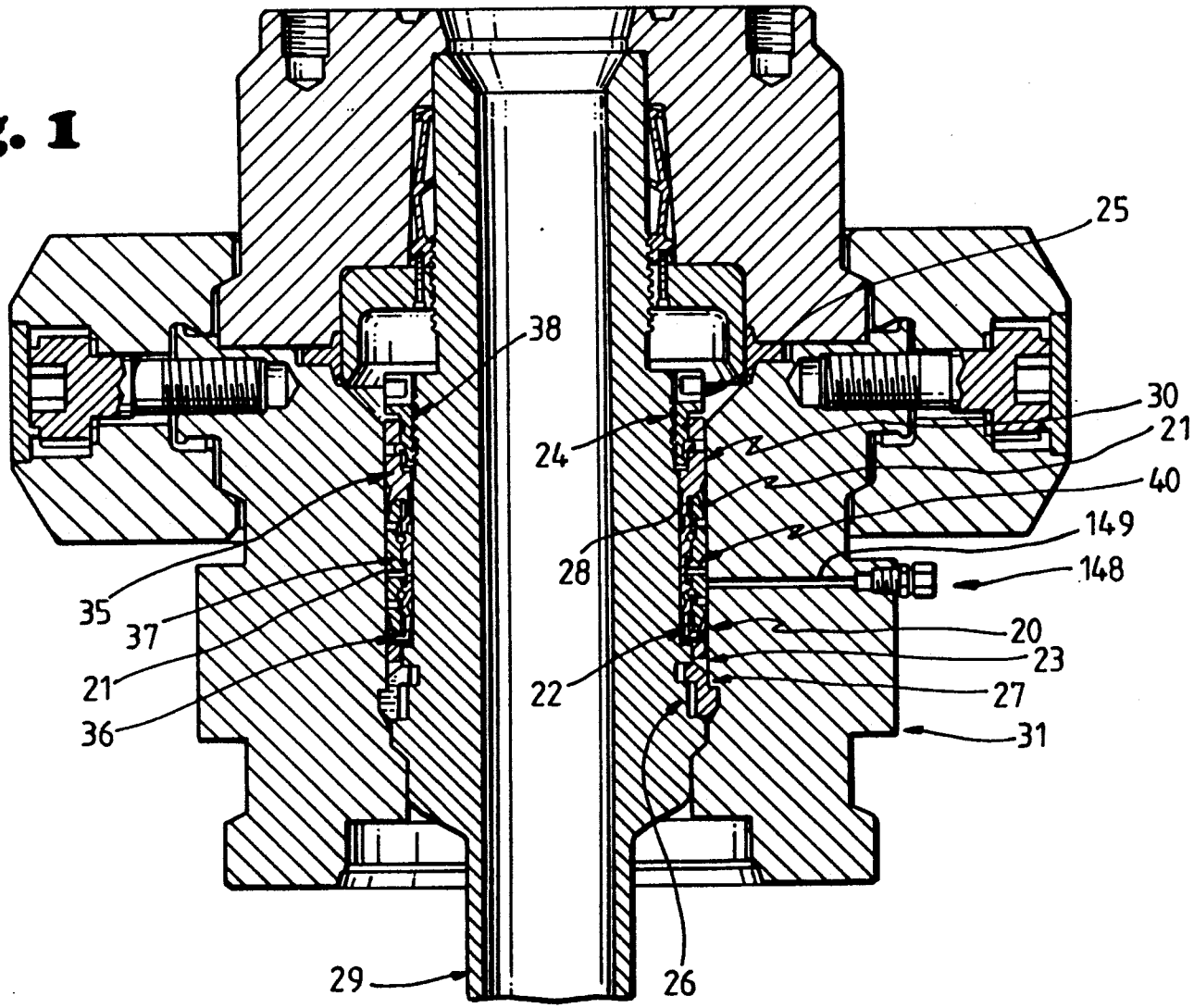
FIG. 1 is a partial cross-sectional view of a wellhead housing provided with the seal assembly of the present invention, a portion of the seal assembly being encircled by dotted lines.

In FIG. 1, a seal assembly 20 in accordance with the present invention is shown disposed in an annulus 21 between concentric spaced apart inner and outer generally cylindrical surfaces 22, 23 with each surface, having an upper portion 24, 25, and a lower portion 26, 27. As illustrated in FIG. 1, inner surface 22 of the annulus 21 is the outer surface 28 of a tubing hanger 29, and outer surface 23 of the annulus 21 is the inner surface 30 of a wellhead housing 31. Seal assembly 20 may be utilized to seal the annulus 21 between a wellhead housing 31 and tubing hanger 29, or as is conventional in the art, between a casing hanger (not shown) and wellhead housing 31. Wellhead housing 31 may be of conventional construction, but is typically part of a "multibowl" wellhead system, wherein seal assembly, or assemblies, 20 are installed through a blowout preventer stack (not shown).

Figure 2:
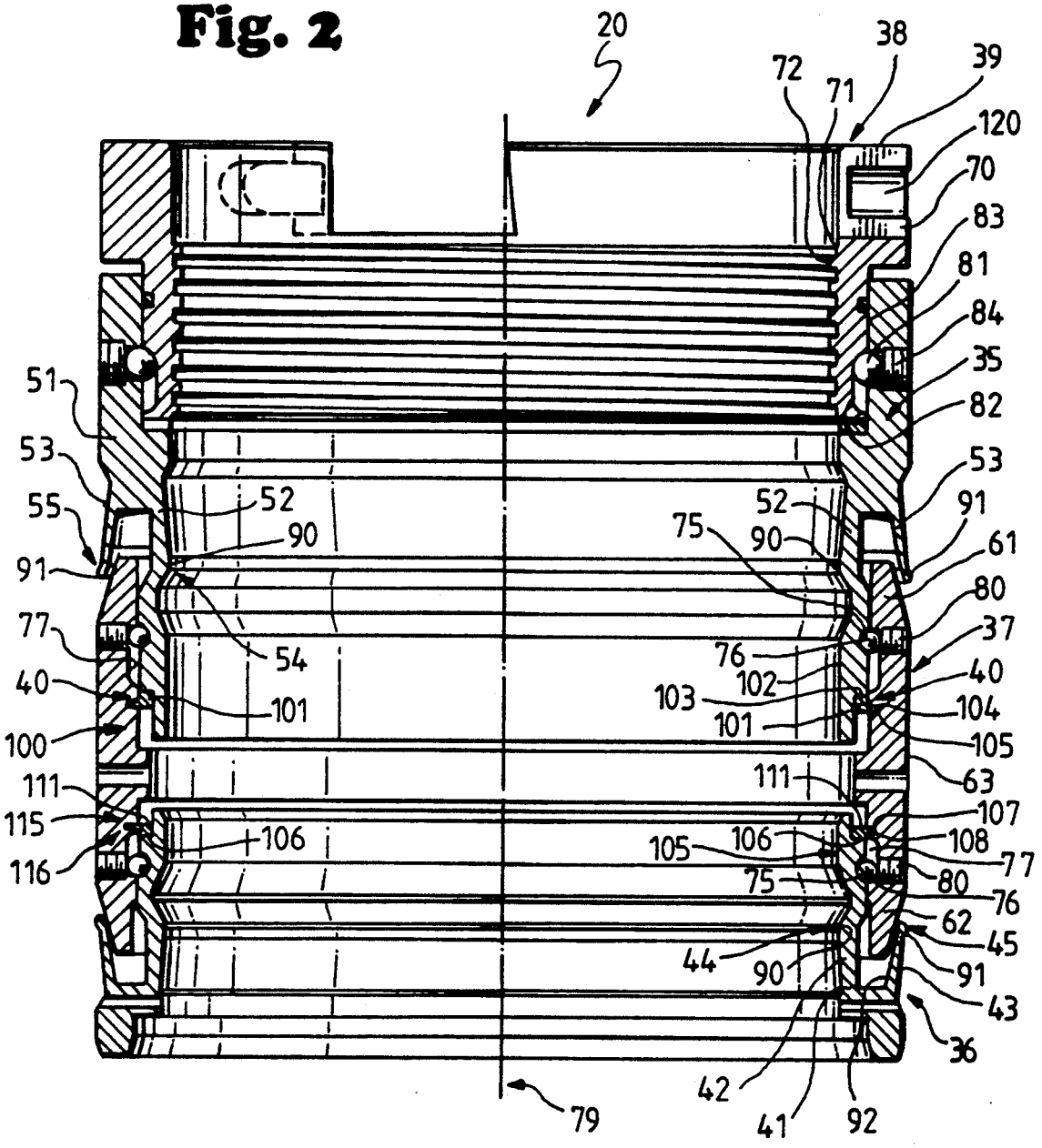
FIG. 2 is a cross-sectional view along the longitudinal axis of a seal assembly of the present invention.

With reference to FIGS. 1 and 2, seal assembly 20 is shown to generally comprise: an upper seal member 35 formed of a metallic material and adapted to be disposed adjacent the upper portions 24, 25 of the inner and outer surfaces 22, 23; a lower seal member 36 formed of a metallic material and adapted to be disposed adjacent the lower portions 26, 27 of inner and outer surfaces 22, 23; an energizing ring member 37, disposed between the upper and lower seal members 35, 36, for energizing the upper and lower seal members 35, 36 to engage, and seal against, adjacent surfaces 24–27; a means for causing relative motion 38 between the energizing ring 37 and the upper and lower seal members 35, 36, or an actuation sleeve member 39; and a first means for staging the energizing 40 of the upper and lower seal members 35, 36 to cause the lower seal member 36 to engage, and seal against, the lower portions 26, 27 of the surfaces 22, 23 before the upper seal member 35 engages, and seals against, the upper portions 24, 25 of the inner and outer surfaces 22, 23. Upper and lower seal members 35, 36, as well as energizing ring member 37 and actuation sleeve member 39, may be made of any suitable metallic material having the required strength characteristics for use in an oil and/or gas well wellhead system, which can be subject to high pressure and temperature conditions, as is known in the industry.

With reference to FIGS. 2–4, lower seal member 36 is a ring-shaped member 41 having a generally U-shaped configuration with inner and outer upwardly extending leg members 42, 43 with an inner seal 44 disposed on the inner leg member 42 and an outer seal 45 disposed on the outer leg member 43. Upper seal member 35 is of a generally similar construction, and comprises a ring-shaped member 51 having a generally U-shaped configuration with inner and outer downwardly extending leg members 52, 53 with an inner seal 54 disposed on the inner leg member 52 and an outer seal 55 disposed on the outer leg member 53. Energizing ring member 37 is disposed between upper and lower seal members 35, 36, and has upper and lower wedges 61, 62 formed integral with centrally disposed ring member 63, the operation of upper and lower wedges to be hereinafter described in greater detail.

Still with reference to FIGS. 2–4, actuation sleeve member 39 is a ring member 70 disposed on top of upper seal member 35, and as will be hereinafter described in greater detail, is rotatably mounted with respect to upper seal member 35. The internal surface 71 of actuation sleeve member 39 is provided with a set of threads which are adapted for threaded engagement with a set of threads 73 (FIGS. 1 and 5) on the upper portion 24 of inner surface 22, or outer surface 28 of tubing hanger 29. Lower seal member 36 and upper seal member 35 are each provided with an annular groove 75 which receives a plurality of balls 76, which balls 76 are also received within an annular groove 77 disposed on the interior surface 78 of energizing ring member 37, whereby upper and lower seal members 35, 36 are releasably connected to energizing ring member 37, and may be moved upwardly and downwardly with respect to energizing ring member 37 along their common longitudinal axis 79, as balls 76 roll within cooperating grooves 75, 77. Suitable openings 80 are provided in energizing ring member 37, to permit balls 76 to pass through energizing ring member 37 and be disposed within cooperating grooves 75, 77. Similarly, actuation sleeve member 39 is rotatably mounted within upper seal member 35, as by a plurality of balls 81 disposed in annular groove 82 formed in the outer surface 83 of actuation sleeve member 39, the balls 81 being passed through an opening 84 in upper seal member 35, whereby actuation sleeve member 39 can be rotated with respect to upper seal member 35.

With reference to FIGS. 2–5, inner seals 54, 44 of upper and lower seal members 35, 36 are preferably interference type seals, which may take the form of an internally disposed annular projection, or rib 90, disposed on the inner leg members 52, 42 of upper and lower seal members 35, 36. As will be hereinafter described in greater detail in connection with FIGS. 5–9, sealing between the inner seals 44, 54 and inner surface 22, or outer surface 28 of tubing hanger 29, is accomplished by an interference fit of the inner seals 44, 54 with their adjacent inner surfaces 26, 24, in that the inner diameter of the projecting rib 90 is slightly smaller than the outer diameter of the surfaces 24, 26, against which inwardly projecting annular ribs 90 are sealed against. Outer seals 55, 45, of upper and lower seal members 35, 36 are preferably wedge type seals, which are preferably formed as an outwardly extending annular projection, or rib, 91 disposed on outer legs 53, 43 of upper and lower seal members 35, 36. Outer seals 55, 45, are placed in sealing engagement with upper and lower outer surfaces 25, 27, or the interior surface 30 of wellhead housing 31, by wedging, or forcing, outer seals 55, 45 into sealing engagement with the adjacent outer surfaces 25, 27. Preferably outer seals 55, 45 are wedged, as will be hereinafter described in greater detail, by upper and lower wedges 61, 62, moving into contact with the interior surfaces 92, 93 of lower outer leg member 43 and upper outer leg member 53, as will be hereinafter described in greater detail.

With reference to FIGS. 2–5, first staging means 40 includes a means for initially restraining movement 100 of the upper seal member 35 with respect to the energizing ring member 37. As will be hereinafter described in greater detail, after a predetermined amount of force is applied and exceeded between the upper seal member 35 and energizing ring member 37, movement of the upper seal member 35 with respect to energizing ring member 37 will then be permitted. Preferably, the means for initially restraining movement 100 of the upper seal member 35 is a first shear ring 101 which engages both the upper seal member 35 and the energizing ring member 37. Preferably, a portion 102 of the downwardly extending inner leg member 52 of upper seal member 35 is provided with a shoulder 103 upon which is seated first shear ring 101. First shear ring 101 has an outer flange portion 104 which is received within a groove 105 disposed within energizing ring member 37. Until a predetermined amount of force is applied downwardly in the direction of longitudinal axis 79, upper seal member 35 will be secured to energizing ring member 37 by first shear ring 101. After the predetermined amount of force is applied and exceeded in the direction of longitudinal axis 79, first shear ring 101 will be sheared, whereby outer flange 104 will remain in groove 105, as upper seal member 35 moves downwardly with respect to energizing ring member 37, at which time, ball 76 will move downwardly within groove 77, as will hereinafter be described in greater detail. Alternatively, at least one shear pin could be utilized in lieu of first shear ring 101 to releasably connect upper seal member 35 to energizing ring member 37 and for initially restraining movement of the upper seal member 35 with respect to the energizing ring member 37, until a predetermined amount of force has been applied and exceeded, as previously described.

Still with reference to FIGS. 2–5, an upper portion 105 of inner leg member 42 of lower seal member 36 is also preferably provided with a shoulder 106 upon which is mounted a second shear ring 111, and outer flange 107 of shear ring 111 is similarly received within groove 107 of energizing ring member 37. Second shear ring 111, as will be hereinafter described in greater detail, serves as a second means for staging 115 the energizing of the inner and outer seals 44, 45, to cause one of the seals 44, 45 of the lower seal member 36 to engage, and seal against, one of the lower portions 26, 27 of one of the surfaces 22, 23, before the other seal 44, 45 of the lower seal member 36 engages, and seals against, the other portion 26, 27 of the other surface 22, 23. Second shear ring 111 serves as a means for initially restraining movement 116 of the lower seal member 36 with respect to the energizing ring member 37, until a predetermined amount of force is applied between the lower seal member 36 and the energizing ring member 37, until a predetermined amount of force is applied between the lower seal member 36 and the energizing ring member 37, as will be hereinafter described in greater detail. Similarly, as previously described, at least one shear pin (not shown) may be utilized in lieu of second shear ring 111 to serve as the means for initially restraining movement 116 of the lower seal member 36 with respect to the energizing ring member 37.

With reference to FIGS. 5–9, a method of the present invention for sealing an annulus 21 between a tubing hanger 29 and a wellhead housing 31 will be described. After seal assembly 20 has been assembled as illustrated in FIG. 2, and after the casing or tubing hanger 29 has been landed in wellhead housing 31, as illustrated in FIG. 1, the seal assembly 20 is run through the blowout preventer stack while attached to a installation tool (not shown). The installation tool may be of conventional construction and have a plurality of projections (not shown) for engagement with a plurality of mating openings 120 disposed along the periphery of actuation sleeve member 39, so as to permit actuation sleeve member 39 to be rotated as will be hereinafter described. Seal assembly 20 may be preferably passed through the blowout preventer stack on one or more joints of drill pipe (not shown). As seal assembly 20 reaches tubing hanger 29, seal assembly 20 slides over the top of the tubing hanger 29 until threads 72 on actuation sleeve member 39 contact the threads 73 at the top of the outer surface 28 of tubing hanger 29. A torque force is applied to actuation sleeve member 39 to rotate actuation sleeve member 39 with respect to upper seal member 35. An axial force along the longitudinal axis 79 of seal assembly 20 is generated by the torque applied to the actuation sleeve member threads 72.

Figure 5:
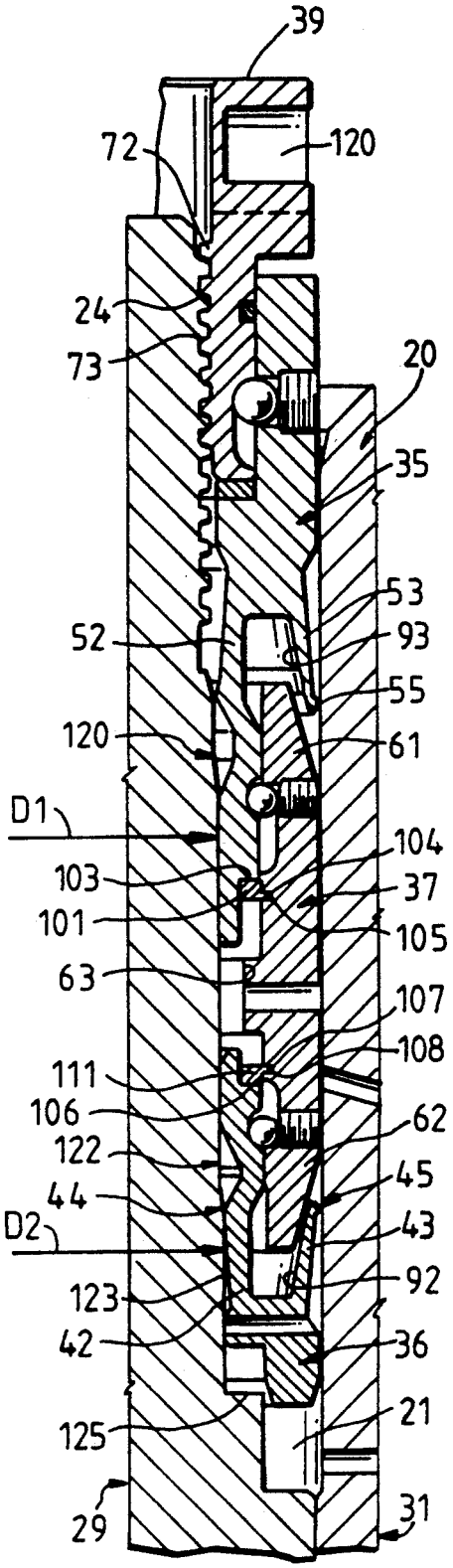
FIGS. 5–9 are partial cross-sectional views of the seal assembly of the present invention illustrating the successive stages of energizing the seal assembly of the present invention to seal an annulus disposed between a wellhead housing and a tubing hanger.

With reference to FIG. 5, outer surface 28 of tubing hanger 29 is provided with a first tapered surface 120 adjacent the inner leg member 52 of upper seal member 35. The first tapered surface 120 tapers downwardly and outwardly toward the upper seal member 35 to provide the tubing hanger 29 with a first enlarged diameter D1 adjacent the inner leg member 52 of upper seal member 35. The outer surface 28 of tubing hanger 29 is further provided with a second tapered surface 122 adjacent the inner leg member 42 of the lower seal member 36, and the second tapered surface 122 tapers downwardly and outwardly toward the lower seal member 36 to provide the tubing hanger 29 with a second enlarged diameter D2 adjacent the inner leg member 42 of lower seal member 35. (Preferably, the second enlarged diameter D2 is greater than the first enlarged diameter D1).

Still with reference to FIG. 5, as the axial force upon seal assembly 20 is generated by the torque force applied to the actuation sleeve member 39, the seal assembly 20 moves downwardly within annulus 21. The inner seal 44, or inwardly projecting annular rib 90, on inner leg member 42 of lower seal member 36 moves downwardly along second tapered surface 122 on tubing hanger 29 and downwardly onto straight portion 123 of tubing hanger 29 which has the second enlarged diameter. Because the inner diameter of inner seal 44, or inwardly projecting annular rib 90, is slightly smaller than second enlarged diameter D2, inner seal 44 is forced into an interference fit with straight portion 123 of the outer surface 28 of tubing hanger 29 which is disposed below second tapered surface 122. The wall surface portion 123 is preferably straight, or disposed substantially parallel with the longitudinal axis 79 of seal assembly 20.

Figure 6:
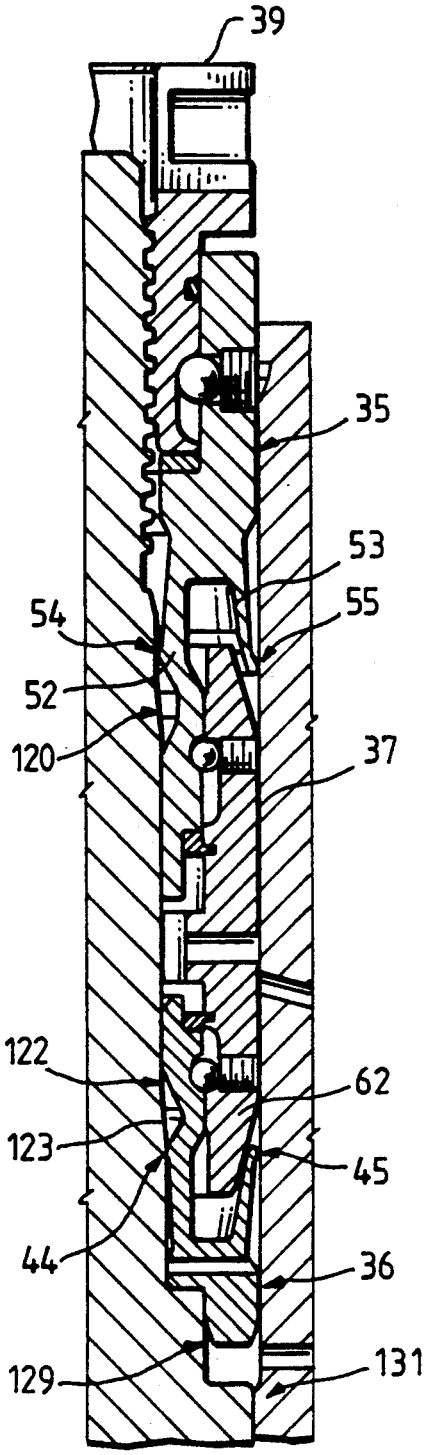

Further rotation of actuation sleeve member 39 causes seal assembly 20 to continue to move downwardly within annulus 21, until the bottom 124 of lower seal member 36 bottoms out on a shoulder 125 disposed on tubing hanger 29, as illustrated in FIG. 6. While seal assembly 20 is moving downwardly within annulus 21, the axial force being applied by the torque force used to rotate actuation sleeve member 39, is insufficient to shear the first shear ring 101 of the means for initially restraining movement 100 of the upper seal member 35 with respect to the energizing ring member 37 of first staging means 40. The axial force generated, while seal assembly 20 moves downwardly from the position illustrated in FIG. 5 to that illustrated in FIG. 6, is also insufficient to shear the second shear ring 111 of the means for initially restraining movement 116 of the lower seal member 36 with respect to the energizing ring member 37 of the second staging means 115. Thus, as seal assembly moves downwardly within annulus 21 from the position illustrated in FIG. 5 to that illustrated in FIG. 6, inner seal 44 remains in an interference fit with the straight portion 123 of the tubing hanger 29. During this downward movement, outer seal 45 of outer leg member 43 of lower seal member 36 is in engagement with the inner surface 30 of wellhead 31; however, outer seal 45 has not sealed against inner surface 30 of wellhead 31 so as to prevent fluids from passing between outer seal 45 and the inner surface 30 of wellhead housing 31.

While seal assembly is moving downwardly into the configuration shown in FIG. 6, the second means for initially restraining movement 116 of the lower seal member 36 with respect the energizing ring member 39, or second shear ring 111 of the second staging means 115, in addition to transferring the axial force to the lower seal member 36, also prevents premature energizing of the outer seal 45 of lower seal member 36. When seal assembly is in the configuration illustrated in FIG. 6, it should be noted that neither of the seals 54, 55 of the upper seal member 35 are sealed against either the outer surface 28 of tubing hanger 29, or the inner surface 30 of wellhead housing 31. The only seal in sealing engagement, when seal assembly 20 is in the configuration illustrated in FIG. 6, is the inner seal 44 of lower seal member 36.

Figure 7:
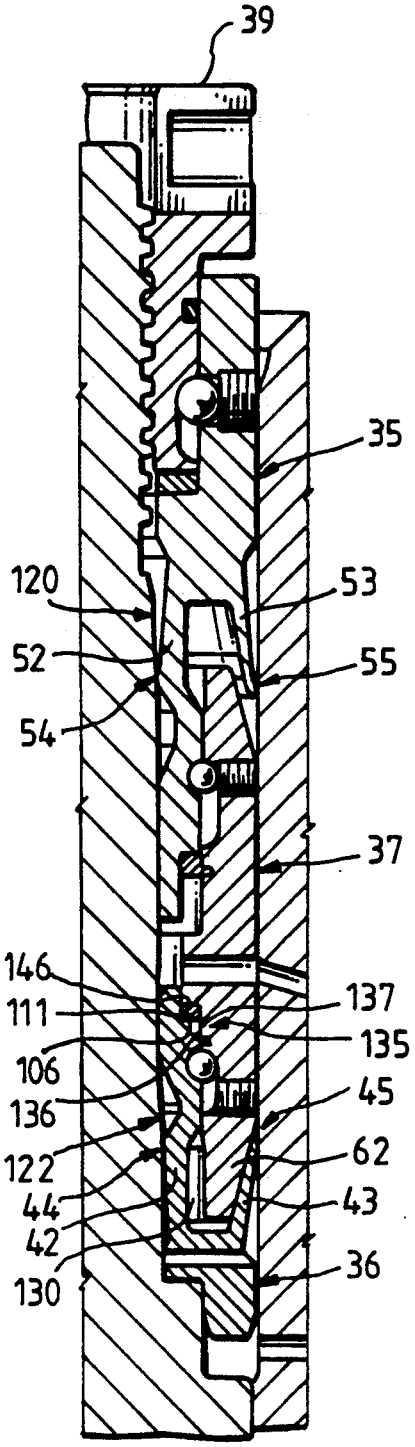

With reference to FIG. 7, upon an additional and increased torque force being applied to actuation sleeve member 39, which force is converted by mating threads 72 and 73 into a downward axial force along longitudinal axis 79 of seal assembly 20, a sufficient axial force is generated to shear second shear ring 111, whereby the central portion of second shear ring 111 remains on the shoulder 106 at the top of lower seal member 36, and the outer flange portion 107 remains in groove 108 disposed in energizing ring member 37. After second shear ring 111 has been sheared, upper seal member 35 and energizing ring member 37 continue to move downwardly within annulus 21, during which time the lower wedge 62 of energizing ring member 37 contacts the tapered inner surface 92 of outer leg member 43 of lower seal member 36 and exerts an outwardly extending force upon outer leg member 43 and outer seal 45 of lower seal member 36. The continued downward movement of upper seal member 35 and energizing ring member 37 causes lower wedge 62 to wedge, or force, the outer seal 45 of lower seal member 36 into sealing engagement with the lower portion 27 qf outer surface 23, or inner surface 30 of wellhead housing 31. As lower wedge 62 forces outer leg member 43 and outer seal 45 of lower seal member 36 outwardly to engage, and seal against, inner surface 30 of wellhead housing 31, the lower wedge is deflected inwardly toward the inner leg member 42 of lower seal member 36.

As seen in FIG. 7, the deflected portion of energizing ring member 37, or lower wedge 62, is spaced from the inner leg member 42 as seen at annular cavity 130. Because of the resilience and the elastic/plastic properties of the metal of which energizing ring member 37 is made, energy is stored in the deflected lower wedge 62, so that it can constantly apply an outwardly extending force to the outer seal 45 of the lower seal member 36 to maintain the outer seal 45 in sealing engagement with the inner surface 30 of the wellhead housing 31. Accordingly, if the tubing hanger 29 and wellhead housing 31, and lower seal member 36 are subjected to differential expansion and contraction caused by temperature changes, the interference type inner seal 44 remains in sealing engagement, as does the outer seal 45 of lower seal member. For example, if tubing hanger 29 were to expand due to exposure to an increased temperature and cause the width of annulus 21 to decrease, outer seal 45 would remain in sealing engagement, while lower wedge 62 would be deflected further inwardly to accommodate the expansion of tubing hanger 29. Upon cooling of tubing hanger 29, and its attendant contraction, which could cause the width of annulus 21 to increase, the energy stored in deflected lower wedge 62 would still be constantly applying an outwardly extending force against out leg member 43 of lower seal member 36, so as to cause outer seal 45 to remain in sealing engagement with inner surface 30 of wellhead housing 31.

While outer seal 45 of lower seal member 36 is being set into the desired sealing engagement with the inner surface 30 of wellhead housing 31, upper seal member 35 and energizing ring member 37 continue to move downwardly until inner shoulder 146 of energizing ring member 137 abuts the top of second shear ring 111 as illustrated in FIG. 7. During this downward movement, the movement of upper seal member 35 with respect to energizing ring member 37 is restrained by the first staging means 40, or first shear ring 101 remaining engaged in both the upper seal member 35 and the energizing ring member 39.

Figure 8:
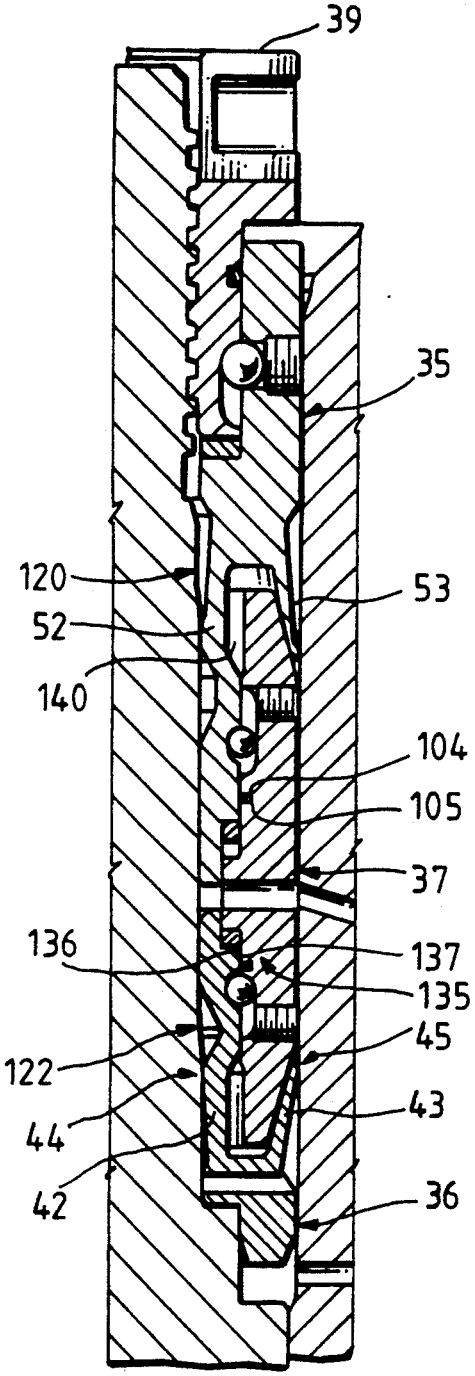

With reference to FIG. 8, after the inner and outer seals 44, 45 of lower seal member have been energized into sealing engagement, as previously described in connection with FIG. 7, an additional torque force is applied to actuation sleeve member 39. This force results in a downwardly extending axial force along longitudinal axis 79 of seal assembly 20, to cause upper seal member 35 to be further compressed downwardly against energizing ring member 37. When the axial force exceeds the force necessary to shear the first shear ring 101, as illustrated in FIG. 8, the central portion of first shear ring 101 remains on shoulder 103 on the inner leg member 52 of the upper seal member 35, and the outer flange 104 of first shear ring 101 remains within groove 105. As upper seal member 35 moves downwardly, the inner seal 45, or inwardly projecting annular rib 90 on the inner leg member 52 of upper seal member 35 passes over first tapered surface 120 and engages, and seals against, the portion of outer surface 28 of tubing hanger 29, disposed below first tapered surface 120, which has the first enlarged diameter D1.

Because of the shearing of first shear ring 101, some of the axial load being applied to the lower seal member 36 may be reduced, whereby it is desirable to prevent energizing ring member 37 from moving upwardly, so as to prevent any loss of the energy being stored in deflected lower wedge 62. Preferably, seal assembly 20 is provided with a means for locking 135 the lower seal member 36 to the energizing ring member 37, after the inner and outer seal 44, 45 of the lower seal member 36 have engaged, and sealed against, their adjacent surfaces 26, 27. Preferably, the locking means 135 comprises mating surfaces 136, 137, disposed upon the upper end of inner leg member 42, and upon energizing ring member 37, which surfaces are designed to create a press fit there between upon energizing ring member 37 moving downwardly from the position illustrated in FIG. 6, into the position illustrated in FIGS. 7.

As upper seal member 35 moves downwardly from the position illustrated in FIG. 7, to that illustrated in FIG. 8, upper wedge 61 contacts the tapered inner surface 93 of the outer leg 53 of upper seal member 35 and wedges, or forces, outer seal 55 of outer leg member 53 of upper seal member 35, into sealing engagement with the inner surface 30 of wellhead housing 31, in the same manner as previously described in connection with the energizing of the outer seal 45 of lower seal member 36. Upper wedge 61 is deflected inwardly toward inner leg 52 of upper seal member 36 and is spaced from inner leg member 52, as by cavity 140. The deflected wedge 61 can then store energy to apply the desired outwardly extending force to the outer leg member 53 of upper seal member 35, to maintain outer seal 55 in the desired sealing engagement with inner surface 30 of wellhead housing 31.

With reference to FIGS. 5–9, it should be noted that the first staging means 40, or first shear ring 101, has an additional function other than staging the energizing of the upper and lower seal members 35, 36 to cause the lower seal member 36 to engage, and seal against, the wellhead housing 31 and tubing hanger 29 before the upper seal member 35 engages, and seals against, the wellhead housing 31 and tubing hanger 29. The first shear ring 101 also serves as a third means for staging the energizing of the inner and outer seals 54, 55 of the upper seal member 35, to cause the inner seal 54 to engage, and seal against, the tubing hanger 29, before the outer seal 55 engages, and seals against, the wellhead housing 31.

Figure 9:
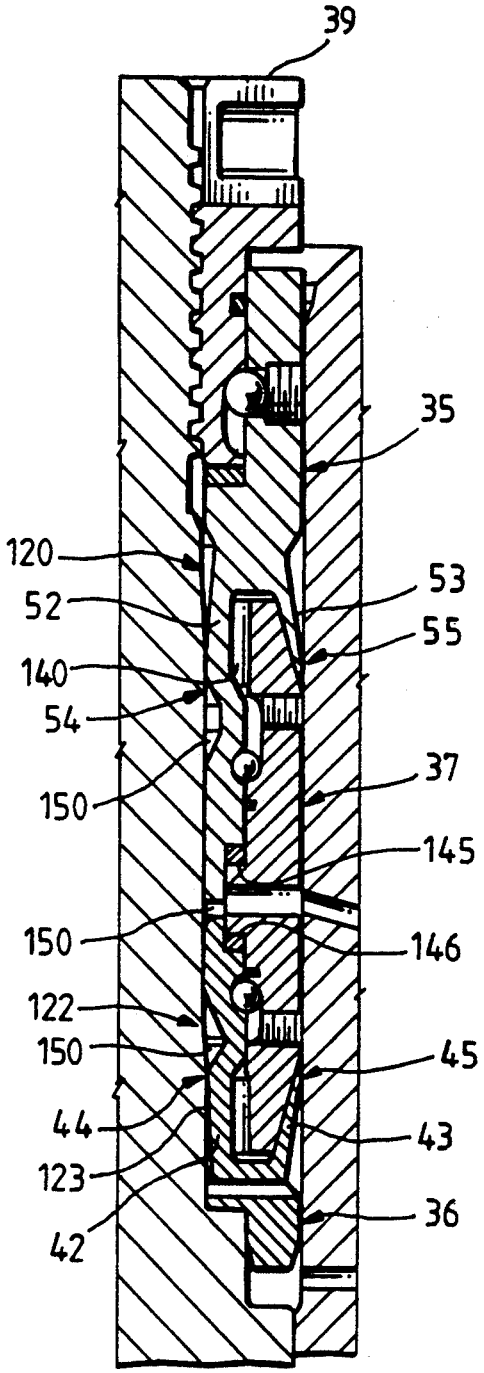

With reference to FIG. 9, actuation sleeve member 39 has been rotated until the first and second shear rings 101, 111 are in an abutting relationship with inner shoulders 145, 146 of energizing ring member 137, at which time no further movement of upper and lower seal members 35, 36, energizing ring member 137, and actuation sleeve member 39 is possible. Seal assembly 20 is thus locked into a relatively solid unit, whereby the seals 44, 45, 54, 55, of upper and lower seal members 35, 36 cannot become disengaged. The pressure integrity of the upper and lower seal members 35, 36 may be tested by applying a pressure force, such as high pressure fluid, from an external source 148 through a test port 149 formed in wellhead housing 31 (FIG. 1) which leads to a cavity 150 (FIG. 9) between the upper and lower seal members 35, 36. The lower seal member 35 is adapted to hold pressure coming from the top of the seal assembly 20, and the pressure force acting on the inner and outer legs 42, 43 of the lower seal member 36 will enhance the contact stresses between the inner and outer seals 44, 45 against the tubing hanger 29 and wellhead housing 31. The upper seal member 35 is likewise adapted to hold pressure forces from below seal assembly 20 in the same manner.

It should be noted that it is possible for a well operator to visually determine whether or not the various seals of seal assembly 20 have been set, as by viewing the instrumentation associated with applying the torque force to the actuation sleeve member 39. For example, the torque readings will remain steady as the seal assembly moves downwardly in annulus 21. When the inner seal 44 of the lower seal member 36 first encounters the first tapered surface 122, as illustrated in FIG. 5, the torque reading will begin to increase, indicating the setting of seal 44. Similarly, the torque reading will increase until the second shear ring is sheared, at which time the torque readings will decrease, thus indicating the shearing of the second shear ring 111 and the subsequent setting of the outer seal 45 of the lower seal member. Similarly, the torque reading will increase as the inner seal 52 of the upper seal member 35 passes downwardly over the first tapered surface 120, indicating the setting of the inner seal 52. The torque reading will also momentarily decrease after the first shear ring 101 has been sheared, indicating the subsequent setting of the outer seal 55 of the upper seal member 35. Continued increases in the torque reading, when actuation sleeve member can no longer be rotated, will indicate that all the seals of the upper and lower seal members 35, 36 have been secured in place.

In connection with seal assembly 20 of FIGS. 1–9, it should be noted that the configuration of the upper and lower seal members 35, 36 could be reversed. The inner seals 44, 54 could be wedge type seals, and the outer seals 45, 55 could be interference type seals.

Figure 10:
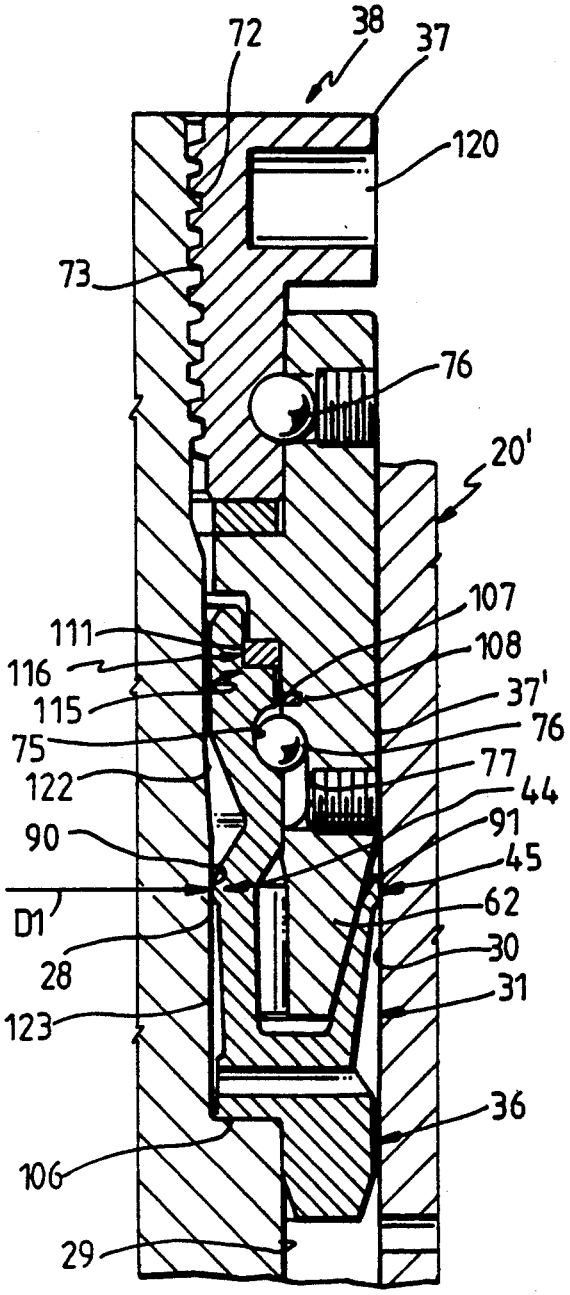
FIG. 10 is a partial cross-sectional view of another embodiment of a seal assembly in accordance with the present invention.

With reference to FIG. 10, another embodiment of seal assembly 20' is illustrated. Identical reference numerals will be utilized for identical elements previously described in connection with FIGS. 1–9, and primed reference numerals will be used for elements of seal assembly 20' which are similar in operation and construction to those previously described in connection with FIGS. 1–9. Seal assembly 20' generally comprises a ring-shaped seal member 36; an energizing ring member 37' for energizing the inner and outer seals 44, 45 of seal member 36 to engage, and seal against their adjacent inner and outer surfaces 28, 30; means for causing relative motion 38 between the energizing ring member 37' and seal member 36, or actuation sleeve member 37; and a means for staging 115 the energizing of the inner and outer seals 44, 45 of the seal member 36 to cause one of the seals 44 or 45 to engage, and seal against, its adjacent surface 28 or 30, before the other seal 44 or 45 engages, and seals against, its adjacent surface 28 or 30. Staging means 115 preferably includes a means for initially restraining movement 116 of the energizing ring member 37' with respect to the seal member 36. Preferably, the movement restraining means 116 is a shear ring 111 which engages both the seal member 36 and the energizing ring member 37', as by a flange 107 disposed within a groove 108 in energizing ring member 37'. The seal assembly 20' of FIG. 10 is illustrated in the fully sealed configuration, after energizing ring member 37' has moved downwardly to shear off the annular flange 107 of shear ring 111, in a manner previously described in connection with FIG. 7.

Tubing hanger 29 is preferably provided with a tapered surface 122 which provides for a first enlarged diameter D1 on straight wall surface portion 123 of tubing hanger 29. The operation of seal assembly 20' is the same as that previously described in connection with the operation of seal member 36 of seal assembly 20, but seal assembly 20' does not utilize an upper seal member as does seal assembly 20'. Seal assembly 20' may be utilized when it is desired to provide a seal assembly when lower pressure conditions are encountered, or for smaller diameter tubing hangers, or when other similar tubing is to be sealed within an outer tubing, or wellhead member.

With reference to FIGS. 11–14, another embodiment of a seal assembly 20'' is illustrated. Seal assembly 20'' generally comprises: an upper seal member 35'; a lower seal member 36'; an energizing ring member 37'; a means for causing relative motion 38, between the energizing ring 37' and the upper and lower seal members 35', 36' or actuation sleeve member 39; and a first means for staging 40 the energizing of the upper and lower seal members 35', 36' to cause the lower seal member 36' to engage, and seal against, its adjacent surfaces 28, 30 before the upper seal member 35' engages, and seals against, its adjacent surfaces 28, 30. The first staging means 40 preferably includes a first means 100 for initially restraining movement of the upper seal member 35' with respect to the energizing ring member 37', until a predetermined amount of force is applied between the upper seal member 35' and the energizing ring member 37'. Preferably, the means for initially restraining movement 100 is a first shear ring 101', as will be hereinafter described in greater detail.

Figure 11:
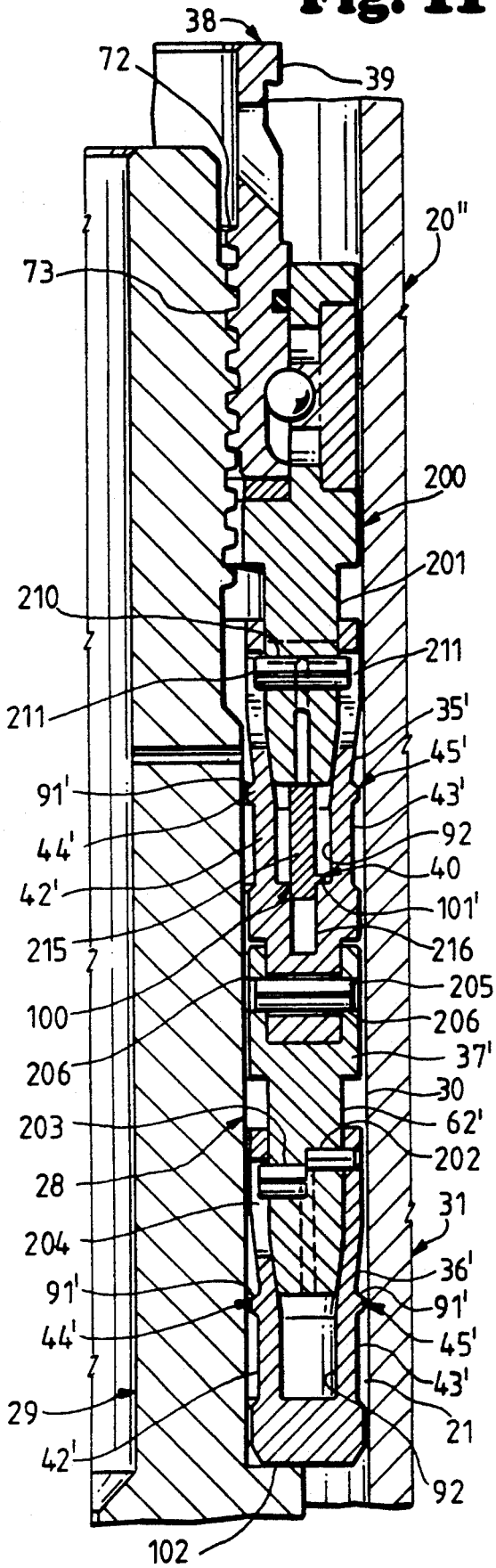
FIGS. 11–13 are partial cross-sectional views of another embodiment of a seal assembly in accordance with the present invention, illustrating the successive stages of energizing the seal assembly.
Figure 12:
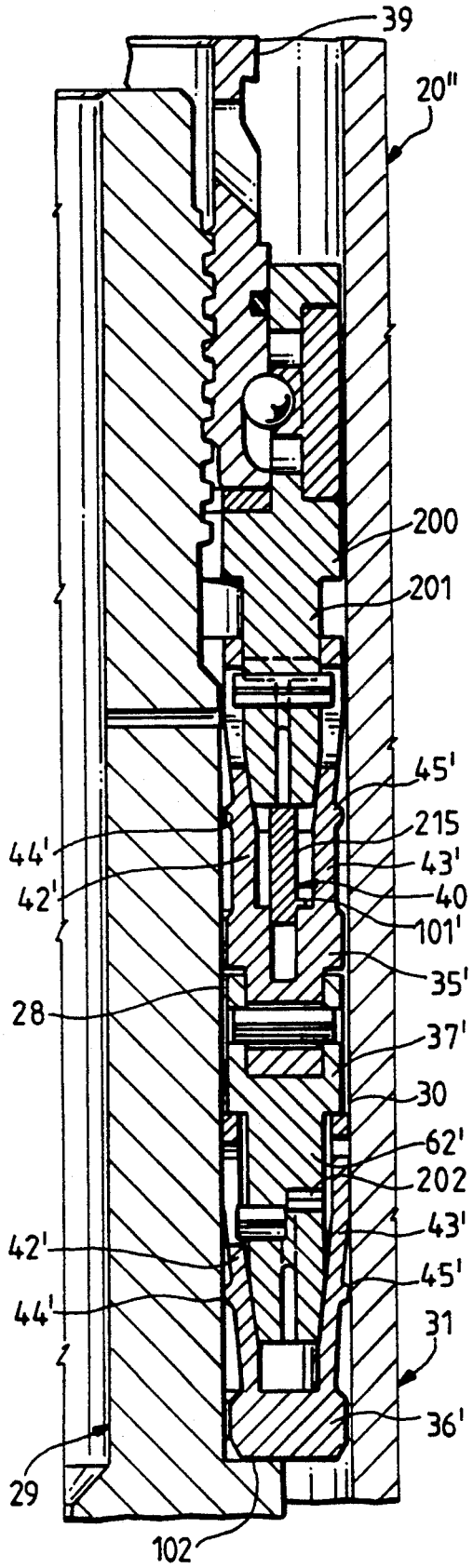
Figure 13:
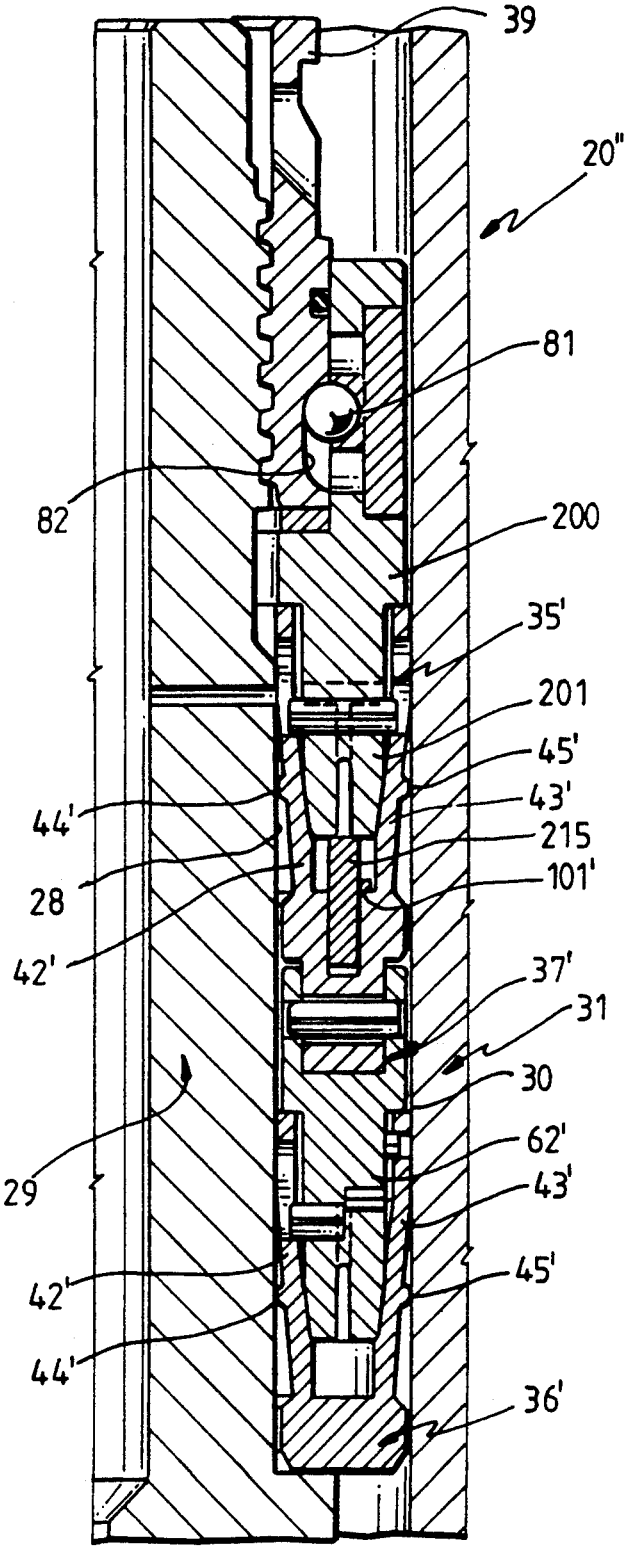

Still with reference to FIGS. 11–13, the upper and lower seal members 35', 36' have a generally U-shaped configuration with inner and outer upwardly extending legs 42', 43'. Each of the leg members 42' has an inner seal 44' disposed thereon, and the outer leg members 43' have an outer seal 45' disposed thereon. Each of the seals 44', 45' is a wedge type seal similar in construction to the outwardly projecting annular rib seal 91 previously described in connection with FIGS. 1–9. Energizing ring member 37' includes a downwardly depending wedge member 62' which, as will be hereinafter described in greater detail, serves to force inner and outer wedge type seals 44', 45' of lower seal member 36' into sealing engagement with tubing hanger 29 and wellhead housing 31. Seal assembly 20'' is also provided with a supplemental energizing ring member 200 which is disposed above upper seal member 35' and below actuation sleeve member 39. Supplemental energizing ring member 200 also has a downwardly depending wedge member 201 which, as will also be hereinafter described in greater detail, moves downwardly within upper seal member 35' to force the inner and outer seals 44', 45' of upper seal member 35' into sealing engagement with tubing hanger 29 and wellhead housing 31.

With reference to FIG. 11, seal assembly 20'' is illustrated in its configuration for being run into annulus 21, and prior to energizing any of the seals 44', 45'. Lower seal member 36' is releasably secured to energizing ring member 37', as by at least one shear pin 202 which engages both wedge member 62' and the upper end of outer leg 43' of lower seal member 36'. A roller pin 203 is secured within wedge member 62', and projects within a slotted opening 204 formed at the upper end of the inner leg member 42' of lower seal member 36'. Upper seal member 35' is secured to energizing ring member 37' by a similar roller pin 205, which passes through the lower portion of upper seal member 35' and is received within mating openings 206 in the upper end of energizing ring member 37'. Wedge member 201 of supplemental energizing ring member 200 is movably mounted within the upper end of upper seal member 35', as by a roller pin 210 which is secured to wedge member 201 and projects outwardly into slotted grooves 211 formed in the upper ends of the inner and outer leg members 42', 43' of upper seal member 35'.

With reference to FIGS. 11–14, the operation of seal assembly 20'' will be described. After the bottom of lower seal member 36' bottoms out upon shoulder 102 of tubing hanger 29, an additional torque force is applied to actuation sleeve member 39 as previously described in connection with the seal assembly 20 of FIGS. 1–9. As additional force is applied, shear pin 202 is sheared, whereby wedge member 62' continues to move downwardly into lower seal member 36' and forces the inner and outer legs 42', 43' of lower seal member 36' into sealing engagement with tubing hanger 29 and wellhead housing 31, as shown in FIG. 12. At this time, the axial force exerted upon seal assembly 20'' is not sufficient to shear the shear ring 101' of energizing staging means 40. Thus, all the axial force is directed downwardly to cause wedge member 62' to outwardly deflect, or force outwardly, the inner and outer leg members 42', 43', of lower seal member 36'. As illustrated in FIG. 12, at this time the seals 44', 45' of upper seal member 35' are not in sealing engagement with tubing hanger 29 and wellhead housing 31.

Figure 14:
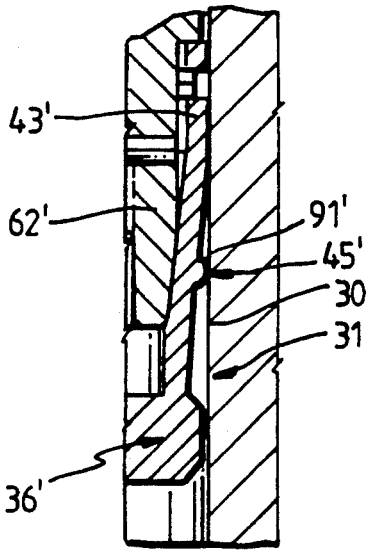
FIG. 14 is an exploded cross-sectional view of a seal member of FIGS. 11–13, upon the seal member being sealed against a wellhead housing.

With reference to FIG. 13, upon an additional torque force being applied to actuation sleeve member 39, supplemental energizing ring member 200 and wedge 201 move downwardly within upper seal member 35' and shear off the shear ring 101'. Shear ring 101' is affixed to a vertical support member 215 disposed between wedge member 201 and upper seal member 35'. Upper seal member 35' has a tubular opening 216 for receipt of the vertical support member 215 after shear pin 101' has been sheared off. Continued application of a torque force to actuation sleeve member 39 results in wedge member 201 moving downwardly to force outwardly the inner and outer legs 42', 43' of upper seal member 35', to cause inner and outer seals 44', 45' into sealing engagement with tubing hanger 29 and wellhead housing 31, as illustrated in FIG. 13. FIG. 14 illustrates, in greater detail, the wedging of one of the seals 44', 45' into sealing engagement with one of the outer surfaces 28, 30.

Figure 15:
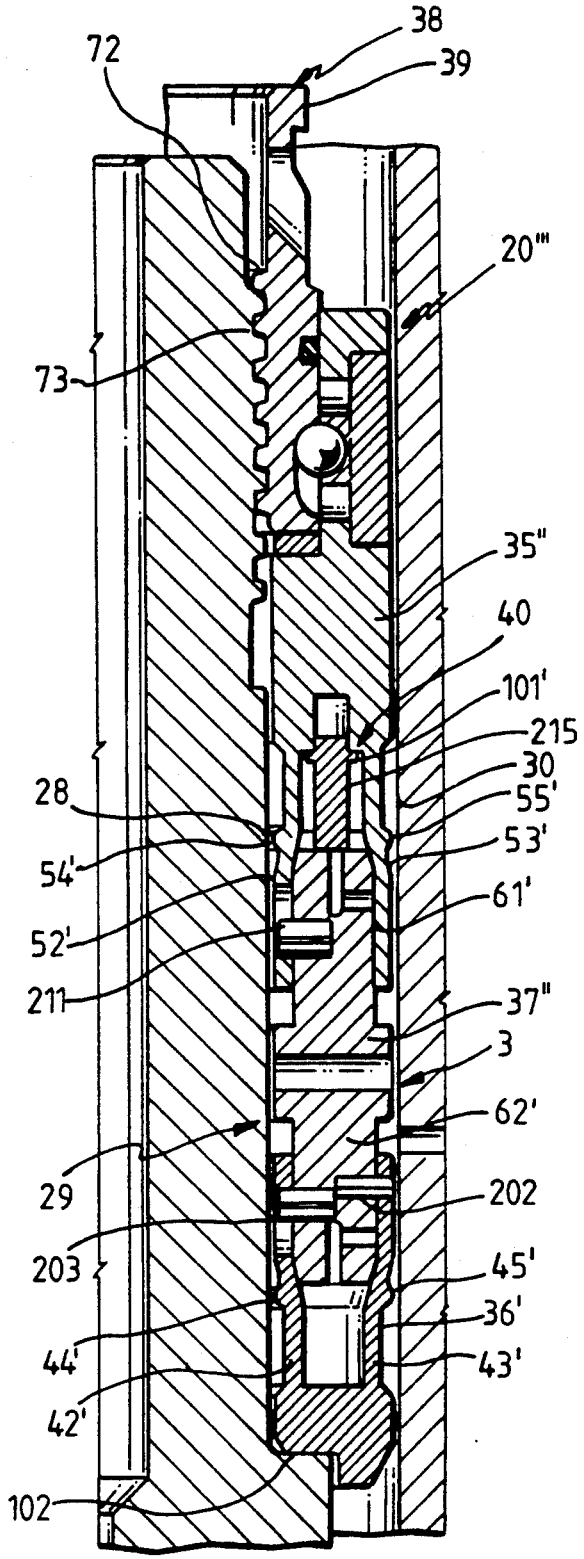
FIGS. 15–16 are partial cross-sectional views of another embodiment of a seal assembly in accordance with the present invention, illustrating the successive stages of energizing the seal assembly.
Figure 16:
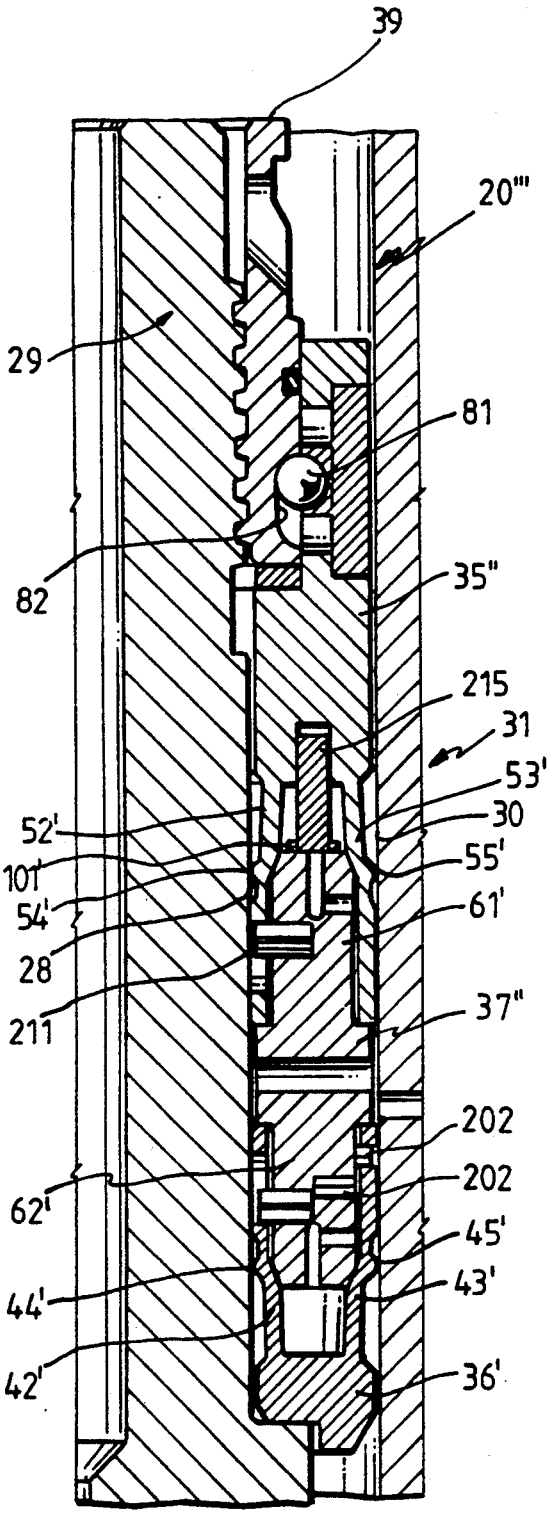

With reference to FIGS. 15 and 16, another sealing assembly 20''' is illustrated, and seal assembly 20''' is very similar in operation and construction to seal assembly 20''. In general, the difference between seal assembly 20''' and seal assembly 20'' is that seal assembly 20''' does not utilize a supplemental energizing ring member 200, and the upper seal member 35'' has downwardly extending leg members 52', 53'. Seal assembly 20''' generally comprises: an upper seal member 35''; a lower seal member 36'; an energizing ring member 37''; means for causing relative motion 38 between the energizing ring member and the upper and lower seal members 35'', 36', or actuation sleeve member 39; and a first means for staging 40 the energizing of the upper and lower seal members 35'', 36' to cause the lower seal member 36' to engage, and seal against, the tubing hanger 29 and wellhead housing 31 before the upper seal member 35'' engages, and seals against the adjacent surfaces 28, 30 of tubing hanger 29 and wellhead housing 31.

Still with reference to FIGS. 15 and 16, energizing ring member 37'' has a lower depending wedge member 62' and an upper wedge member 61', for energizing the lower and upper seal members 36', 35''. Vertical support member 215 has disposed thereon a shear ring 101' which functions in the same manner of the shear ring 101' and vertical support member 215 of FIGS. 11–14. FIG. 15 illustrates seal assembly 20''' after it has been landed upon shoulder 102, before any sealing of seals 44', 45', 54', 55' has been achieved. FIG. 16 illustrates seal assembly 20''', after shear pin 202 has been sheared, thus energizing lower seal member 36'; and after shear pin 101' has been sheared off. Upper wedge member 61' has entered the interior of upper seal member 35'' and energized seals 54', 55' of upper seal member 35'', by wedging inner and outer leg members 52', 53' of upper seal member 35'' outwardly into engagement with tubing hanger 29 and wellhead housing 31.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

We claim:

1. A seal assembly for sealing an annulus between concentric spaced apart inner and outer generally cylindrical surfaces, each surface having an upper and a lower portion, the seal assembly adapted to be disposed within the annulus, comprising:

an upper seal member formed of a metallic material and adapted to be disposed adjacent the upper portions of the surfaces;

a lower seal member formed of a metallic material and adapted to be disposed adjacent the lower portions of the surfaces;

an energizing ring member, disposed between the upper and lower seal members, for energizing the upper and lower seal members to engage, and seal against, adjacent surfaces;

means for causing relative motion between the energizing ring member and the upper and lower seal members; and first means for staging the energizing of the upper and lower seal members to cause the lower seal member to engage, and seal against, the lower portions of the surfaces before the upper seal member engages, and seals against, the upper portions of the surfaces.

2. The seal assembly of claim 1, wherein the first staging means includes a means for initially restraining movement of the upper seal member with respect to the energizing ring member, until a predetermined amount of force is applied between the upper seal member and the energizing ring member.

3. The seal assembly of claim 2, wherein the means for initially restraining movement of the upper seal member is a first shear ring which engages both the upper seal member and the energizing ring member.

4. The seal assembly of claim 2, wherein the means for initially restraining movement is at least one first shear pin which engages both the upper seal member and the energizing ring member.

5. The seal assembly of claim 2, wherein the lower seal member has an inner seal adapted for engaging, and sealing against, the lower portion of the inner generally cylindrical surface, and an outer seal adapted for engaging, and sealing against, the lower portion of the outer generally cylindrical surface; and a second means for staging the energizing of the inner and outer seals of the lower seal member, to cause one of the seals of the lower seal member to engage, and seal against, one of the lower portions of one of the surfaces, before the other seal of the lower seal member engages, and seals against, the other lower portion of the other surface.

6. The seal assembly of claim 5, wherein the second staging means includes a means for initially restraining movement of the lower seal member with respect to the energizing ring member, until a predetermined amount of force is applied between the lower seal member and the energizing ring member.

7. The seal assembly of claim 6, wherein the means for initially restraining movement of the lower seal member is a second shear ring which engages both the lower seal member and the energizing ring member.

8. The seal assembly of claim 6, wherein the means for initially restraining movement of the lower seal member is at last one second shear pin which engages both the lower seal member and the energizing ring member.

9. The seal assembly of claim 6, wherein the means for initially restraining movement of the upper and lower seal members with respect to the energizing ring member are first and second shear rings, the first shear ring engaging both the upper seal member and the energizing ring member and the second shear ring engaging both the lower seal member and the energizing ring member; the shear strength of the first shear ring being greater than the shear strength of the second shear ring.

10. The seal assembly of claim 6, wherein the means for initially restraining movement of the upper and lower seal members with respect to the energizing ring member are at least one first and at least one second shear pins, the first shear pin engaging both the upper seal member and the energizing ring member and the second shear pin engaging both the lower seal member and the energizing ring member; the shear strength of the first shear pin being greater than the shear strength of the second shear pin.

11. The seal assembly of claim 5 wherein: the upper seal member has an inner seal adapted for engaging, and sealing against, the upper portion of the inner generally cylindrical surface, and an outer seal, adapted for engaging, and sealing against, the upper portion of the outer generally cylindrical surface; and a third means for staging the energizing of the inner and outer seals of the upper seal member, to cause one of the upper seals of the seal member to engage, and seal against, one of the upper portions of one of the surfaces, before the other seal of the upper seal member engages, and seals against, the other upper portion of the other surface.

12. The seal assembly of claim 11, wherein the first means for staging the energizing of the upper and lower seal members also functions as the third means for staging the energizing of the inner and outer seals of the upper seal member.

13. The seal assembly of claim 11, wherein the third staging means is a shear ring which engages both the upper seal member and the energizing ring member.

14. The seal assembly of claim 11, wherein the third staging means is at least one shear pin which engages both the upper seal member and the energizing ring member.

15. The seal assembly of claim 5, further including a means for locking the lower seal member to the energizing ring member, after the inner and outer seals of the lower seal member have engaged, and sealed against, the lower portions of the surfaces.

16. The seal assembly of claim 15, wherein the means for locking includes an interference fit between a portion of the energizing ring member and the lower seal member.

17. The seal assembly of claim 5, wherein the lower seal member is a ring-shaped member having a generally U-shaped configuration with inner and outer upwardly extending leg members, the inner seal is disposed on the inner leg member and the outer seal is disposed on the outer leg member; and a portion of the energizing ring member engages the inner and outer leg members.

18. The seal assembly of claim 17, wherein the inner seal is an interference type seal, wherein sealing between the inner seal and the lower portion of the inner surface is accomplished by an interference fit of the inner seal disposed on the inner leg member with the lower portion of the inner surface; and the outer seal is a wedge type seal, wherein the sealing between the outer seal and the lower portion of the outer surface is accomplished by the outer seal being wedged into sealing engagement with the lower portion of the outer surface.

19. The seal assembly of claim 18, wherein a portion of the energizing ring member engages the outer leg member to wedge the outer seal into sealing engagement with the lower portion of the outer surface, which causes a portion of the energizing ring member to be deflected inwardly toward the inner leg member; and the deflected portion of the energizing ring member applies an outwardly extending force upon the outer leg member to maintain the outer seal in sealing engagement with the lower portion of the outer surface.

20. The seal assembly of claim 19, wherein the deflected portion of the energizing ring member is spaced from the inner leg member to permit the deflected portion of the energizing ring to store energy to apply the outwardly extending force to the outer leg member and outer seal.

21. The seal assembly of claim 11, wherein the upper seal member is a ring-shaped member having a generally U-shaped configuration with inner and outer downwardly extending leg members, the inner seal is disposed on the inner leg member and the outer seal is disposed on the outer leg member; and a portion of the energizing ring member engages the inner and outer leg members.

22. The seal assembly of claim 21, wherein the inner seal is an interference type seal, wherein sealing between the inner seal and the upper portion of the inner surface is accomplished by an interference fit of the inner seal, disposed on the inner leg member, with the upper portion of the inner surface; and the outer seal is a wedge type seal, wherein the sealing between the outer seal and the upper portion of the outer surface is accomplished by the outer seal being wedged into sealing engagement with the upper portion of the outer surface.

23. The seal assembly of claim 22, wherein a portion the energizing ring member engages the outer leg member to wedge the outer seal into sealing engagement with the upper portion of the outer seal surface, which causes a portion of the energizing ring member to be deflected inwardly toward the inner leg member; and the deflected portion of the energizing ring member applies an outwardly extending force upon the outer leg member to maintain the outer seal in sealing engagement with the upper portion of the outer surface.

24. The seal assembly of claim 23, wherein the deflected portion of the energizing ring member is spaced from the inner leg member to permit the deflected portion of the energizing ring to store energy to apply the outwardly extending force to the outer leg member and outer seal.

25. The seal member of claim 1, wherein the means for causing relative motion between the energizing ring and the upper and lower seal members is an actuation sleeve member which comprises the upper and lower seal members against the energizing ring member.

26. A seal assembly for sealing an annulus between concentric spaced apart inner and outer generally cylindrical surfaces, each surface having an upper and a lower portion, the seal assembly adapted to be disposed within the annulus, comprising:

an upper ring-shaped seal member formed of a metallic material and adapted to be disposed adjacent the upper portions of the surfaces, the upper seal member having a generally U-shaped configuration with inner and outer downwardly extending leg members, with an inner seal disposed on the inner leg member and an outer seal disposed on the outer leg member;

a lower ring-shaped seal member formed of a metallic material and adapted to be disposed adjacent the lower portions of the surfaces, the lower seal member having a generally U-shaped configuration with inner and outer upwardly extending leg members, with an inner seal disposed on the inner leg member and an outer seal disposed on the outer leg member;

an energizing ring member, disposed between the upper and lower seal members, for energizing the upper and lower seal members to engage, and seal against the surfaces;

means for causing relative motion between the energizing ring member and the upper and lower seal members; and the inner seals on the upper and lower inner leg members are interference type seals and sealing between the inner seals and their adjacent inner surfaces is accomplished by an interference fit of the inner seals, disposed on the inner leg members, with their adjacent inner surfaces; and the outer seals are wedge type seals, and the sealing between the outer seals and their adjacent outer surfaces is accomplished by the outer seals being wedged into sealing engagement with the adjacent outer surfaces.

27. The seal assembly of claim 26, wherein portions of the energizing ring member engage the outer leg members to wedge the outer seals into sealing engagement with their adjacent outer surfaces, which causes portions of the energizing ring member to be deflected inwardly toward the inner leg members, and the deflected portions of the energizing ring member apply an outwardly extending force upon the outer leg member to maintain the outer seals in sealing engagement with the adjacent outer surfaces.

28. The seal assembly of claim 27, wherein the deflected portions of the energizing ring member are spaced from the inner leg members to permit the deflected portions of the energizing ring to store energy to apply the outwardly extending force to the outer leg members and outer seals.

29. The seal assembly of claim 26, wherein the means for causing relative motion between the energizing ring and the upper and lower seal members is an actuation sleeve member which compresses the upper and lower seal members against the energizing ring member.

30. A seal assembly for sealing an annulus between an outer surface of an oil and/or gas well tubing or casing hanger and an inner surface of a well head housing, the seal assembly adapted to be disposed within the annulus in sealing engagement with the outer and inner surfaces of the hanger and the wellhead housing, comprising:

an upper ring-shaped seal member formed of a metallic material and having a generally U-shaped configuration with inner and outer downwardly extending leg members, with an inner seal disposed on the inner leg member and an outer seal disposed on the outer leg member;

a lower ring-shaped seal member formed of a metallic material and having a generally U-shaped configuration with inner and outer upwardly extending leg members, with an inner seal disposed on the inner leg member and an outer seal disposed on the outer leg member;

an energizing ring member, disposed between the upper and lower seal members, for energizing the upper and lower seal members to engage and, seal against, the surfaces;

means for causing relative motion between the energizing ring member and the upper and lower seal members; and the outer surface of the hanger has a first tapered surface adjacent the inner leg member of the upper seal member, which first tapered surface tapers downwardly and outwardly toward the upper seal member to provide the hanger with a first enlarged diameter adjacent the inner seal of the inner leg member of the upper seal member; and the outer surface of the hanger has a second tapered surface adjacent the inner leg member of the lower seal member, which second tapered surface tapers downwardly and outwardly toward the lower seal member to provide the hanger with a second enlarged diameter adjacent the inner seal of the inner leg member of the lower seal member.

31. The seal assembly of claim 30, wherein the inner seals on the upper and lower inner leg members are interference type seals and sealing between the inner seals and their adjacent hanger outer surfaces is accomplished by an interference fit of the inner seals, disposed on the inner leg members, with their adjacent hanger outer surfaces; and the outer seals are wedge type seals, and sealing between the outer seals and their adjacent wellhead housing inner surfaces is accomplished by the outer seals being wedged into sealing engagement with the adjacent wellhead inner surfaces.

32. The seal assembly of claim 31, wherein portions of the energizing ring member engage the outer leg members to wedge the outer seals into sealing engagement with their adjacent inner wellhead surfaces, which causes portions of the energizing ring member to be deflected inwardly toward the inner leg members, and the deflected portions of the energizing ring member apply an outwardly extending force upon the outer leg members to maintain the outer seals in sealing engagement with the adjacent inner wellhead surfaces.

33. The seal assembly of claim 32, wherein the deflected portions of the energizing ring member are spaced from the inner leg members to permit the deflected portions of the energizing ring to store energy to apply the outwardly extending force to the outer leg members and outer seals.

34. The seal assembly of claim 30, wherein the means for causing relative motion between the energizing ring and the upper and lower seal members is an actuation sleeve member which compresses the upper and lower seal members against the energizing ring member.

35. The seal assembly of claim 34 wherein the outer surface of the hanger has a set of threads which mate with a set of threads disposed on an inner surface of the actuation sleeve member, whereby the actuation sleeve member may be rotated, with respect to the hanger, to move downwardly to compress the upper and lower sleeve members against the energizing ring member.

36. The seal assembly of claim 30, the second enlarged diameter is larger than the first enlarged diameter of the hanger outer surface.

37. The seal assembly of claim 30, wherein the inner seals of the inner leg members of the upper and lower seal members do not seal against the first and second tapered surfaces of the hanger.

38. A seal assembly for sealing an annulus between concentric spaced apart inner and outer generally cylindrical surfaces, the seal assembly adapted to be disposed within the annulus, comprising a ring-shaped seal member formed of a metallic material and having a generally U-shaped configuration with inner and outer upwardly extending leg members with an inner seal disposed on the inner leg member adjacent the inner surface and an outer seal disposed on the outer leg member adjacent the outer surface;

an energizing ring member for energizing the inner and outer seals to engage, and seal against, their adjacent inner and outer surfaces;

means for causing relative motion between the energizing ring member and the seal member; and means for staging the energizing of the inner and outer seals to cause one of the seals to completely engage, and seal against, its adjacent surface, before the other seal completely engages, and seals against, its adjacent surface.

39. The seal assembly of claim 38, wherein the staging means include a means for initially restraining movement of the energizing ring member with respect to the seal member.

40. The seal assembly of claim 39, wherein the movement restraining means is a shear ring with engages both the seal member and the energizing ring member.

41. The seal assembly of claim 39, wherein the movement restraining means is at least one shear pin which engages both the seal member and the energizing pin member.

42. The seal assembly of claim 38, wherein the means for causing relative motion is an actuation sleeve member which is rotatable with respect to the seal member and the energizing ring member; and rotational movement of the actuation sleeve member compresses the energizing ring member against the seal member.

43. The seal assembly of claim 38, wherein the inner seal is an interference type seal, and sealing between the inner seal and its adjacent inner surface is accomplished by an interference fit therebetween; and the outer seal is a wedge type seal, and the sealing between the outer seal and its adjacent outer surface is accomplished by the outer seal being wedged into sealing engagement with its adjacent outer surface.

44. The seal assembly of claim 43, wherein a portion of the energizing ring member engages the outer leg member to wedge the outer seal into sealing engagement with its adjacent outer surface, which causes a portion of the energizing ring member to be deflected inwardly toward the inner leg member; and the deflected portion of the energizing ring member applies an outwardly extending force upon the outer leg member to maintain the outer seal in sealing engagement with its adjacent outer surface.

45. The seal assembly of claim 44, wherein the deflected portion of the energizing ring member is spaced from the inner leg member to permit the deflected portion of the energizing ring to store energy to apply the outwardly extending force to the outer leg member and outer seal.

46. A method for sealing an annulus between concentric, spaced apart inner and outer generally cylindrical surfaces, each surface having an upper and a lower portion, comprising the steps of:

a) providing a seal assembly, having upper and lower metallic seal members, within the annulus adjacent the inner and outer surfaces, the lower seal member having an inner seal for engaging, and sealing against, the lower portion of the inner surface and an outer seal for engaging, and sealing against, the lower portion of the outer surface;

b) energizing the seal assembly to first cause one of the seals of the lower seal member to completely engage, and seal against, one of the lower portions of one of the surfaces, before the other seal of the lower seal member completely engages, and seals against, the other lower portion of the other surface, and before the upper seal member has engaged, and sealed against, the upper portions of the surfaces; and c) energizing the seal assembly to then cause the upper seal member to engage, and seal against, the upper portions of the surfaces.

47. The method of claim 46, further including the steps of: first locking the lower seal member to maintain the inner and outer seals of the lower seal member in sealing engagement with the lower portions of the inner and outer surfaces, after the inner and outer seals of the lower seal member have sealed against the lower portions of the surfaces; and thereafter energizing the seal assembly to cause the upper seal member to engage, and seal against, the upper portions of the surfaces.

48. The method of claim 46, including the steps of: utilizing as the lower seal member inner seal an interference type seal, and sealing between the inner seal and the lower portion of the inner surface by forcing the inner seal into an interference fit with the lower portion of the inner surface; utilizing as the outer seal a wedge type seal, and sealing between the outer seal and the lower portion of the outer seal by wedging the outer seal into sealing engagement with the lower portion of the outer surface.

49. The method of claim 48, including the step of energizing the lower seal member inner seal before energizing the outer seal.

50. The method of claim 48, including the step of storing energy in a part of the seal assembly to constantly apply an outwardly extending force to the outer seal of the lower seal member.

51. The method of claim 46, including the steps of: utilizing an upper seal member having an inner seal for engaging, and sealing against, the upper portion of the inner surface, and an outer seal for engaging, and sealing against, the upper portion of the outer surface; and energizing the seal assembly to cause one of the seals of the upper seal member to engage, and seal against, one of the upper portions of one of the surfaces, before the other seal of the upper seal member engages, and seals against, the other upper portion of the other surface.

52. The method of claim 51, including the step of: utilizing as the inner seal an interference type seal, and sealing between the inner seal and the upper portion of the inner surface by forcing the inner seal into an interference fit with the upper portion of the inner surface; and utilizing as the outer seal a wedge type seal, and sealing between the outer seal and the upper portion of the outer surface by wedging the outer seal into sealing engagement with the upper portion of the outer surface.

53. The method of claim 52, including the step of energizing the upper seal member inner seal before energizing the upper seal member outer seal.

54. The method of claim 52, including the step of storing energy in a part of the seal assembly to constantly apply an outwardly extending force to the outer seal of the upper seal member.

55. The method of claim 46, including the step of applying a pressure force from an external source to a cavity, disposed between the upper and lower seal members, to test the pressure integrity of the upper and lower seal members.

56. The method of claim 46, including the step of utilizing a torque force to energize the upper and lower seal members of the seal assembly.

57. The method of claim 56, wherein the torque force is applied to the seal assembly by rotating an actuation sleeve member downwardly into engagement with the upper seal member to cause relative motion between the upper seal member and the lower seal member.

58. A method for sealing an annulus between concentric, spaced apart inner and outer generally cylindrical surfaces, each surface having an upper and a lower portion, comprising the steps of:

a) providing a seal assembly having upper and lower metallic seal members, within the annulus adjacent the inner and outer surfaces, each seal member having first and second seals thereon;

b) providing an energizing ring member disposed between the upper and lower seal members;

c) disposing the first seals of the upper and lower seal members against adjacent upper and lower portions of the inner surface;

d) disposing the second seals of the upper and lower seal members against adjacent upper and lower portions of the outer surface;

e) utilizing interference fit seals as one of the seals for the upper and lower seal members;

f) utilizing wedge type seals as the other seals for the upper and lower seal members; and g) causing relative movement between the energizing ring member and the upper and lower seal members to energize the seal assembly to cause the first and second seals of the upper and lower seal members to engage, and seal against, the inner and outer surfaces.

59. The method of claim 58, including the steps of utilizing, as the first seals of the upper and lower seal members, interference fit seals; and utilizing, as the second seals of the upper and lower seal members, wedge-type seals.

60. The method of claim 59, including the step of storing energy in a part of the seal assembly to constantly apply an outwardly extending force to the second seals of the upper and lower seal members.

61. The method of claim 59, including the step of applying a pressure force from an external source to a cavity disposed between the upper and lower seal members to test the pressure integrity of the upper and lower seal members.

62. The method of claim 61, including the step of utilizing a torque force to energize the upper and lower seal members of the seal assembly.

63. The method of claim 62, wherein the torque force is applied to the seal assembly by rotating an actuation sleeve member downwardly into engagement with the upper seal member to cause relative motion between the upper seal member and the lower seal member.

64. The method of claim 58, including the step of sealing the first seals of the upper and lower seal members against an inner surface which is parallel with the longitudinal axis of the seal assembly.

* * * * *